US006464532B1

(12) United States Patent
L'Abbate et al.

(10) Patent No.: US 6,464,532 B1
(45) **Date of Patent: *Oct. 15, 2002**

(54) CONNECTOR FOR A FLAT FOIL CONDUCTOR

(75) Inventors: Carlo L'Abbate, Ludwigshafen (DE); Michael Siotto, Aschaffenburg (DE); Josef Woller, Griesheim (DE)

(73) Assignee: AMP Deutschland GmbH, Langen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/661,668

(22) Filed: Sep. 14, 2000

(51) Int. Cl.[7] ..... H01R 13/58
(52) U.S. Cl. ..... 439/467; 439/499
(58) Field of Search ..... 439/446, 445, 439/465, 464, 467, 472, 499, 492

(56) References Cited

U.S. PATENT DOCUMENTS 3,904,261 A * 9/1975 Cooney ..... 439/465
3,989,336 A * 11/1976 Rizzio et al. ..... 439/499
4,068,912 A * 1/1978 Hudson, Jr. et al. ..... 439/499
4,172,626 A * 10/1979 Olsson ..... 439/465
4,225,205 A * 9/1980 Sinclair et al. ..... 439/467
4,248,491 A * 2/1981 Mouissie ..... 439/465
4,448,474 A * 5/1984 Melnychenko ..... 439/465
4,548,460 A * 10/1985 Dózsa et al. ..... 439/472
4,687,263 A * 8/1987 Cosmos et al. ..... 439/499
4,740,867 A * 4/1988 Roberts et al. ..... 439/499
5,944,554 A * 8/1999 Armand et al. ..... 439/499

* cited by examiner

*Primary Examiner*—Hien Vu

(57) ABSTRACT

A connector for at least one flat foil conductor of a flat foil with at least one electrical contact for connecting to and making contact with the flat foil conductor on the one hand and for making contact with a mating contact on the other hand, with a housing with at least one receiving chamber for receiving the contact, with a cable-side end, with a back wall and with a part movable relative to the back wall which can be fixed in an end position parallel to the back wall, wherein the flat foil comes to rest between back wall and part, and the back wall has at least one opening and the part has at least one pin (11) which engages in the end position through the flat foil in the opening and thereby provides a strain relief for the flat foil.

14 Claims, 8 Drawing Sheets

CONNECTOR FOR A FLAT FOIL CONDUCTOR

BACKGROUND OF THE INVENTION

The invention relates to a connector for at least one flat foil conductor.

DESCRIPTION OF THE PRIOR ART

A connector for at least one flat foil conductor is known from U.S. Pat. No. 4,082,402. The electrical connector has a housing with a plurality of electrical contacts arranged in a row, the contacts being suitable for conductive connection to the flat foil conductors of a foil and for contacting a mating contact. The housing has a flap hingeably articulated to the housing by a film hinge. The flap is latchably connectable to the housing in an end latching position. The flap serves to protect the connections of the electrical contacts to the flat foil conductors. Additional securing of the contacts in the contact chambers is not provided by the hinged flap. It is also not proposed to provide further strain relief on the connector.

From EP 866 520 it is known per se to position flat foil conductors by pins on the housing and corresponding openings in the flat foil conductors thereby also providing a strain relief.

SUMMARY OF THE INVENTION

It is the object of the invention to provide an electrical connector for a flat foil conductor which has an additional strain relief for the flat foil.

The object is achieved by a connector for at least one flat foil conductor of a flat foil comprising: at least one electrical contact for connecting to and making contact with the flat foil conductor and for making contact with a mating contact, a housing with at least one receiving chamber for receiving the contact and having a cable-side end, a back wall and a part movable relative to the back wall that can be fixed in an end position parallel to the back wall, wherein the flat foil is positioned between the back wall and the part, characterized in that the back wall or the movable part has at least one opening and the other has at least one pin that in the end position, engages through the flat foil in the opening and thereby provides strain relief for the flat foil. The connector according to the invention is suitable for contacting at least one flat foil conductor of a flat foil. In this case the flat foil conductor is connected to an electrical contact. A corresponding contact is known, for example from U.S. Pat. No. 4,082,402.

It is of particular advantage that a plurality of flat foil conductors of a flat foil can be contacted by a connector according to this invention. For this purpose, each flat foil conductor is connected to an electrical contact. Such contact can be produced, for example, by a crimp connection. The electrical contacts furthermore have a region for making contact with a mating contact. This region can be designed as a pin contact or a socket contact.

The electrical contacts and at least the free end of the flat foil with the flat foil conductors are inserted in a housing. The electrical contacts in this case come to rest in corresponding receiving chambers. It is of particular advantage that a movable part is provided which can be fixed in an end position parallel to a back wall of the housing, wherein the flat foil and the contacts can be introduced into the housing only when the part is not in the end position.

It is furthermore of particular advantage that the back wall has at least one opening and the movable part at least one pin which engages in the opening in the end position. The reverse arrangement is also possible. Since the flat foil is located between back wall and movable part, the pin also grips through a corresponding opening provided in the flat foil and thereby additionally fixes the flat foil. A strain relief for the flat foil is achieved by this fixing.

It is furthermore of particular advantage that the distance between back wall and movable part is dimensioned in the end position in such a way that the flat foil is pressed between back wall and part. As a result an additional strain relief for the flat foil is achieved in the end position.

It is furthermore of particular advantage that the movable part has a pre-latching position into which the flat foil and the contact can be inserted and an end latching position in which the flat foil is fixed.

It is furthermore of particular advantage if the part is hingeably articulated on the housing. As a result it is ensured that no additional independent part is necessary and therefore loss of the movable part is not possible.

It is furthermore of particular advantage that the openings and pins on the movable part and on the back wall are designed in such a way that they also serve as latching means. As a consequence the surface pressure on the flat foil is increased and therefore the strain relief is improved.

It is furthermore of particular advantage that a guide is provided for the flat foil. The guide for the flat foil is achieved in that the housing has side walls and that these have grooves extending towards the cable-side end in the connection direction for receiving the edges of the flat foil.

It is furthermore of particular advantage that the contacts are additionally secured. This is achieved in that a hinged flap is provided on the housing which in its end position narrows the receiving chambers for the contacts in such a way that removal of the contacts from the chambers is no longer possible.

DETAILED DESCRIPTION OF THE PREFERRED EMBODIMENT

Figure 1:
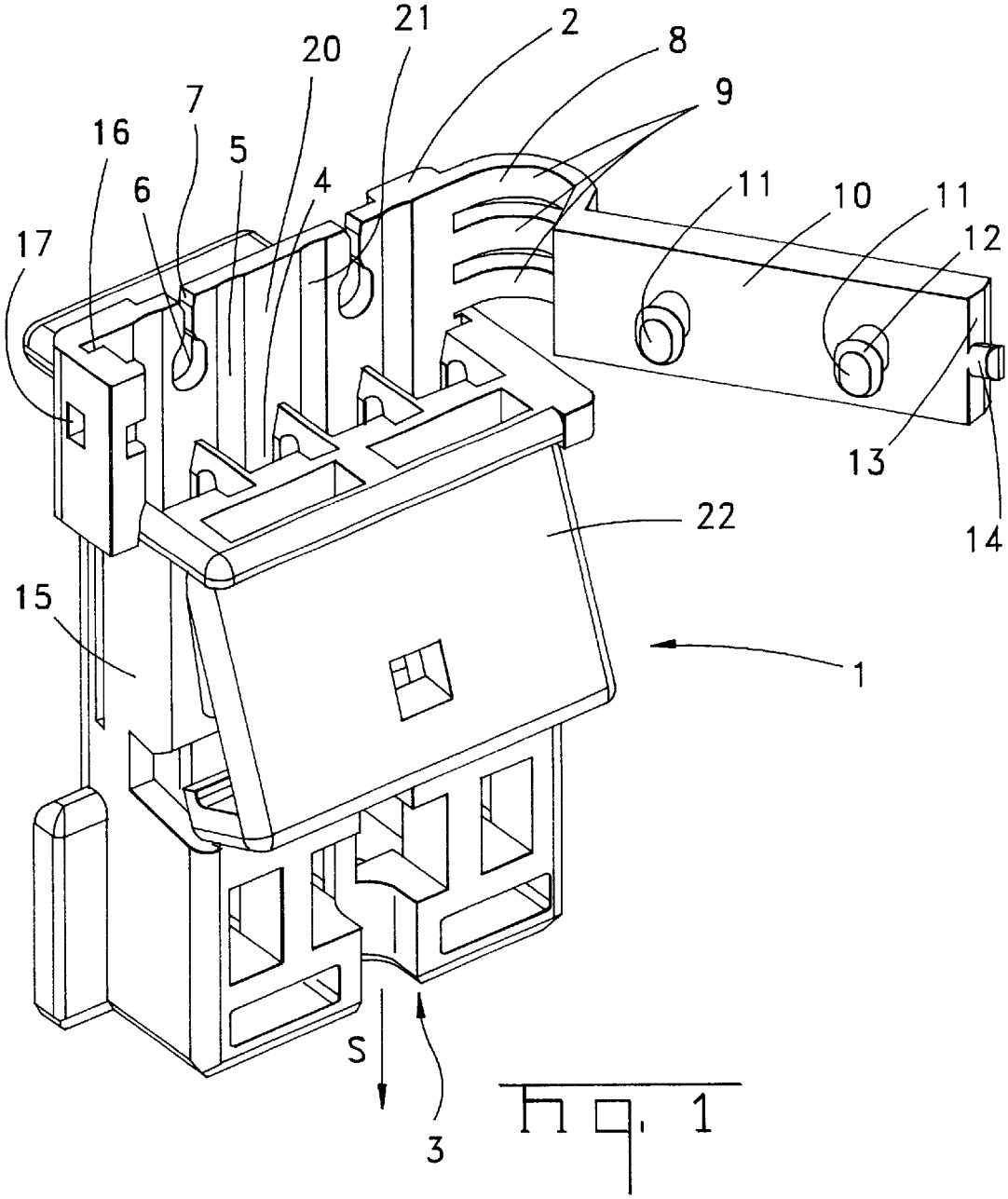
FIG. 1 shows a perspective view of a housing of a first embodiment of a connector according to the invention.
Figure 2:
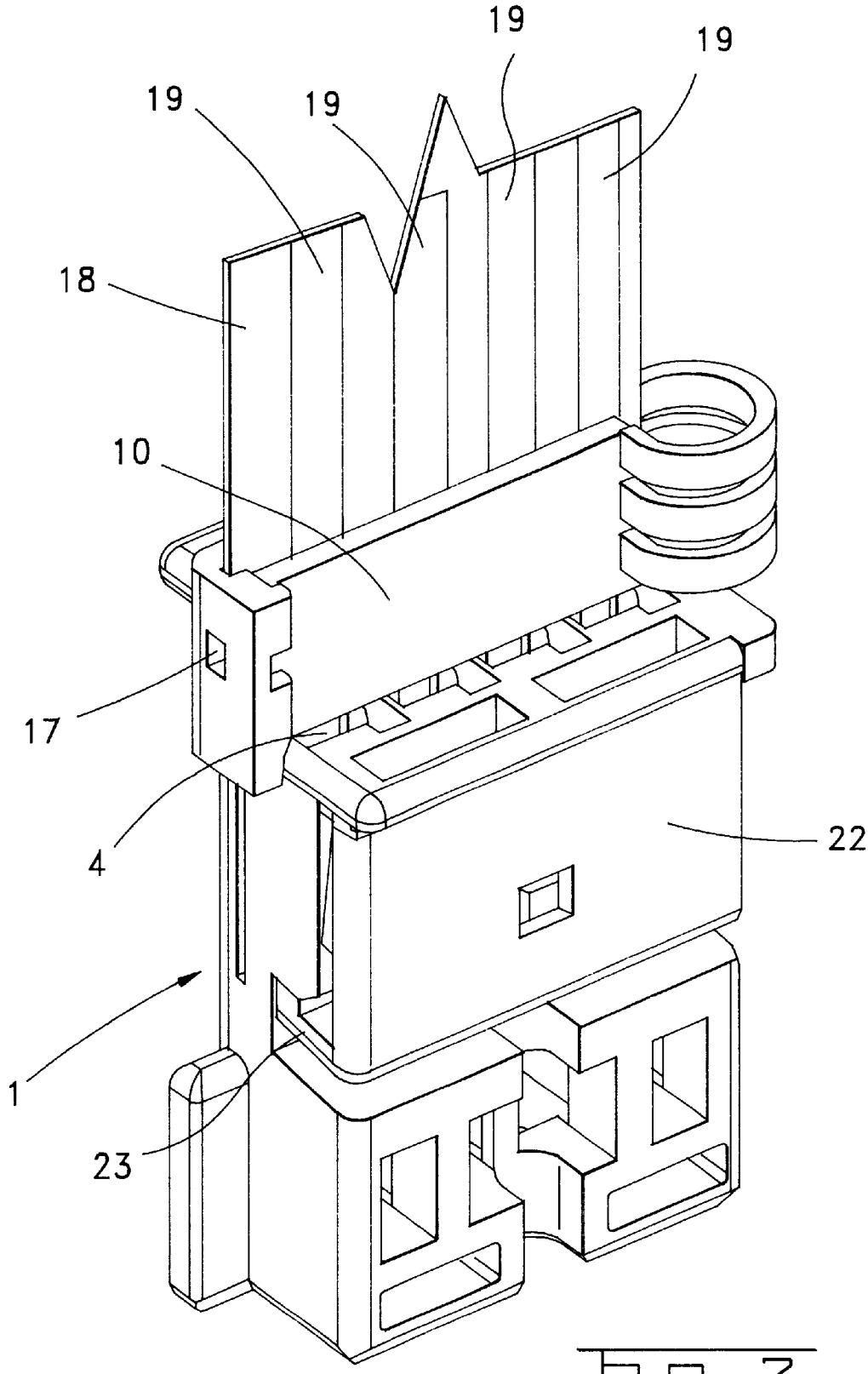
FIG. 2 shows a perspective view of the electrical connector in accordance with FIG. 1 in end position with an inserted flat foil.

Referring to FIGS. 1 and 2, a first embodiment of the invention will now be explained. In FIG. 1, a housing 1 of an electrical connector according to the invention for at least one foil conductor is illustrated. The housing 1 has a cable-side end 2 and a front end 3. For the purpose of making contact with a mating connector, the illustrated connector is inserted with the front end 3 into a mating connector.

The housing 1 furthermore has four receiving chambers 4 for receiving electrical contacts. The receiving chambers 4 extend substantially from the cable-side end 2 to the front end 3. The four receiving chambers 4 are arranged in one plane.

A back wall 5 extends parallel to this plane on the cable-side end 2. The back wall 5 has two openings 6. The back wall 5 is slit between the openings 6 and the cable-side end 2. The slit 7 is provided so that the openings 6 can be elastically somewhat enlarged.

A movable part 10 is connected to the back wall 2 by a band hinge 8 composed of three independent bands 9. The bands 9 of the band hinge 8 are connected to a side of the back wall 5 in this case in such a way that the movable part 10 can be pivoted substantially about an axis of rotation which extends parallel to the connection direction S. The connection direction S gives the direction in this case in which the electrical connector can be joined together with a mating connector.

The movable part 10 has two pins 11. The pins 11 each have a thickening 12 at their free ends. On the end 13 remote from the band hinge 8 the part 10 furthermore has a tongue 14. This has a side wall 15 on the side of the back wall 5 remote from the band hinge 8. The side wall 15 extends substantially perpendicularly to the back wall 5. It has a groove 16 extending in the connection direction which is open toward the cable-side end 2 of the connector. It also has a latching groove 17. By rotating the movable part about the axis of rotation it is possible to insert the tongue 14 in the latching opening 17 by means of the band hinge 8. In so doing the pins 11 are also inserted in the openings 6, the pins 11 latching in the openings 6 as a result of the bead-like thickening 12.

In FIG. 2 the end position of the part 10 in the housing 1 is illustrated. The tongue 14 is latched in the latching opening 17.

In addition a flat foil 18 with four flat foil conductors 19 is inserted in the connector. The flat foil 18 is composed of plastic films between which the flat foil conductors 19 are stored. The flat foil conductors 19 are provided with electrical contacts (not shown) which are inserted in the corresponding receiving chambers 4.

The insertion of the flat foil 18 with the contacts into the housing 1 is only possible when the movable part 10 is in the opened position as illustrated in FIG. 1. In this case the flat foil 18 has two openings which are arranged in such a way that after insertion of the contacts and the flat foil 18 into the housing 1 these openings come to rest above the openings 6 in the back wall 5 of the housing 1.

If the movable part is now brought into its end position then not only the tongue 14 engages in the latching opening 17, but the pins 11 also engage in the openings 6. Since the pins 11 therefore grip through the openings in the flat foil 18 this is securely fixed to the housing. A strain relief is achieved.

As a result of the latching of the pins 11 in the openings 6, a pressing of the flat foil 18 between the movable part 10 and the back wall 5 in the end position of the movable part 10 however also takes place. This surface pressure serves as an additional strain relief. It is particularly advantageous in this case if, as illustrated in FIG. 1, the back wall 5 has projecting regions 20 and slightly set back regions 21. As a result the surface pressure can be increased specifically in the region of the flat foil but not for example in the region of the flat foil conductor.

In order to fix the contacts in the receiving chambers 4 it is furthermore of particular advantage to provide a hinged flap 22 on the housing 1 which has a pre-latching position, as illustrated in FIG. 1, and an end latching position, as illustrated in FIG. 2. In the end latching position the free end 23 of the hinged flap 22 engages in the receiving chambers 4 and narrows their internal width whereby it is ensured that the contacts are secured in the receiving chambers 4. An insertion of the contacts into the receiving chambers 4 is only possible when the hinged flap 22 is in the pre-latching position.

A second embodiment of the invention will now be explained with the aid of FIGS. 3 and 4. A housing 101 of a connector according to the invention is initially also illustrated here in FIG. 3. The housing 101 has a cable-side end 102 and a front end 103. A plurality of contact chambers are arranged next to one another in one plane. There is a back wall 105 parallel to this plane. The back wall 105 has two openings 106. In addition a side wall 115 is arranged on each side of the back wall. The side wall 115 has a groove 116 which serves to receive the edges 124 of the flat foil 118 with the flat foil conductors 119. The groove 116 continues in a slit 125 in the housing.

As in the first embodiment, a hinged flap 122 is also provided for securing the contacts in the receiving chambers. The hinged flap 122 is illustrated in FIG. 3 in its pre-latching position and in FIG. 4 in its end latching position.

A movable part 110 is provided opposite the back wall 105. The movable part 110 is also hingeably connected to the housing 1 by a film hinge 108. The axis of rotation of the film hinge 108 extends in this case substantially perpendicularly to the connection direction S of the connector. The movable part 110 has two pins 111. The movable part 110 furthermore has two latching lances 114 for latching in corresponding latching openings 117 in the side walls 115.

Figure 3:
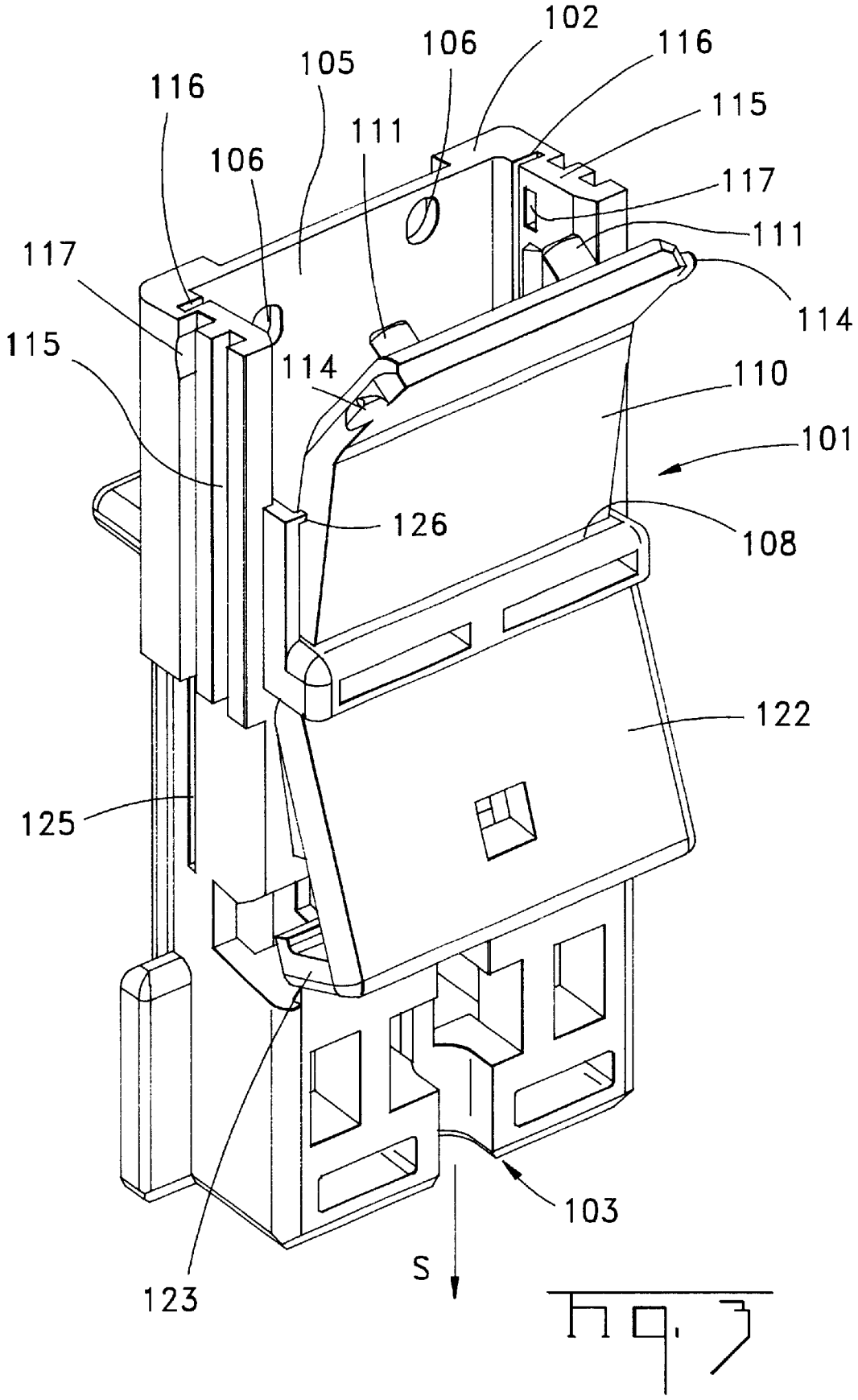
FIG. 3 shows a perspective view of a housing of a second embodiment of a connector according to the invention.
Figure 4:
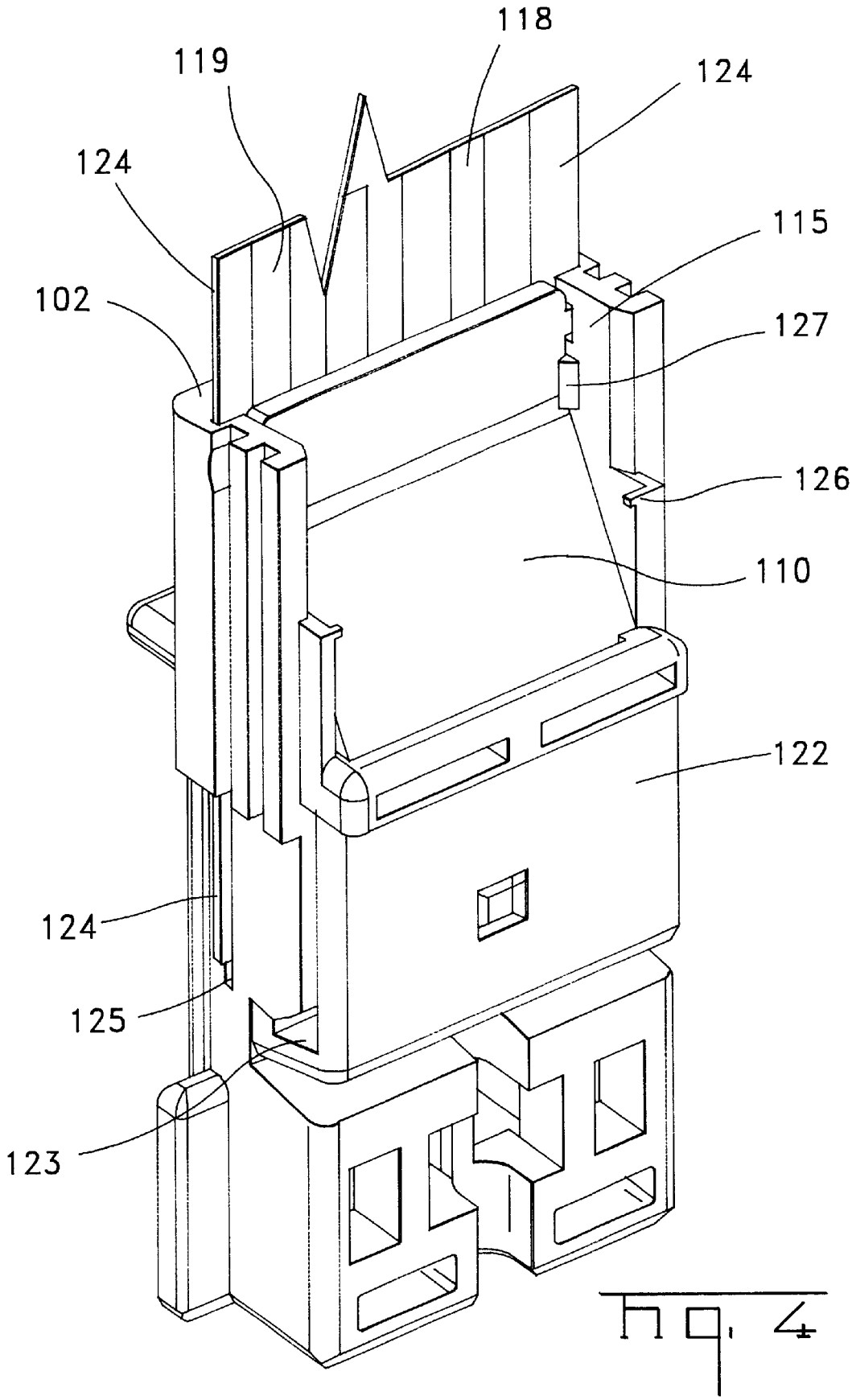
FIG. 4 shows a perspective view of the connector in accordance with the second embodiment with inserted foil in end position.

In the pre-latching position of the movable part 110 illustrated in FIG. 3 this movable part is connected to the side walls 115 of the housing 101 by connecting webs 126. Upon a first activation of the movable part 110 into the end position the connecting webs 126 are broken off from the movable part 110. The movable part latches with the latching tongues 114 in the latching openings 117 of the side walls 115. In addition the side walls 115 have elevations 127 behind which the movable part 110 is located when it is in the end position. In the end position the pins 111 of the movable part 110 engage in the openings 106 of the back wall 105.

Strain relief is provided not only by the pins 111 which grip in the openings 106 and through the foil, but in addition through the surface pressure between the movable part 110 and the back wall 105 in this embodiment also.

A third embodiment of a connector according to the invention will now be described with the aid of FIGS. 5 to 8. The third embodiment is designed very similarly to the first two embodiments. The differences are in the way in which the movable part 210 moves and how it is accordingly secured to the housing 201.

Figure 5:
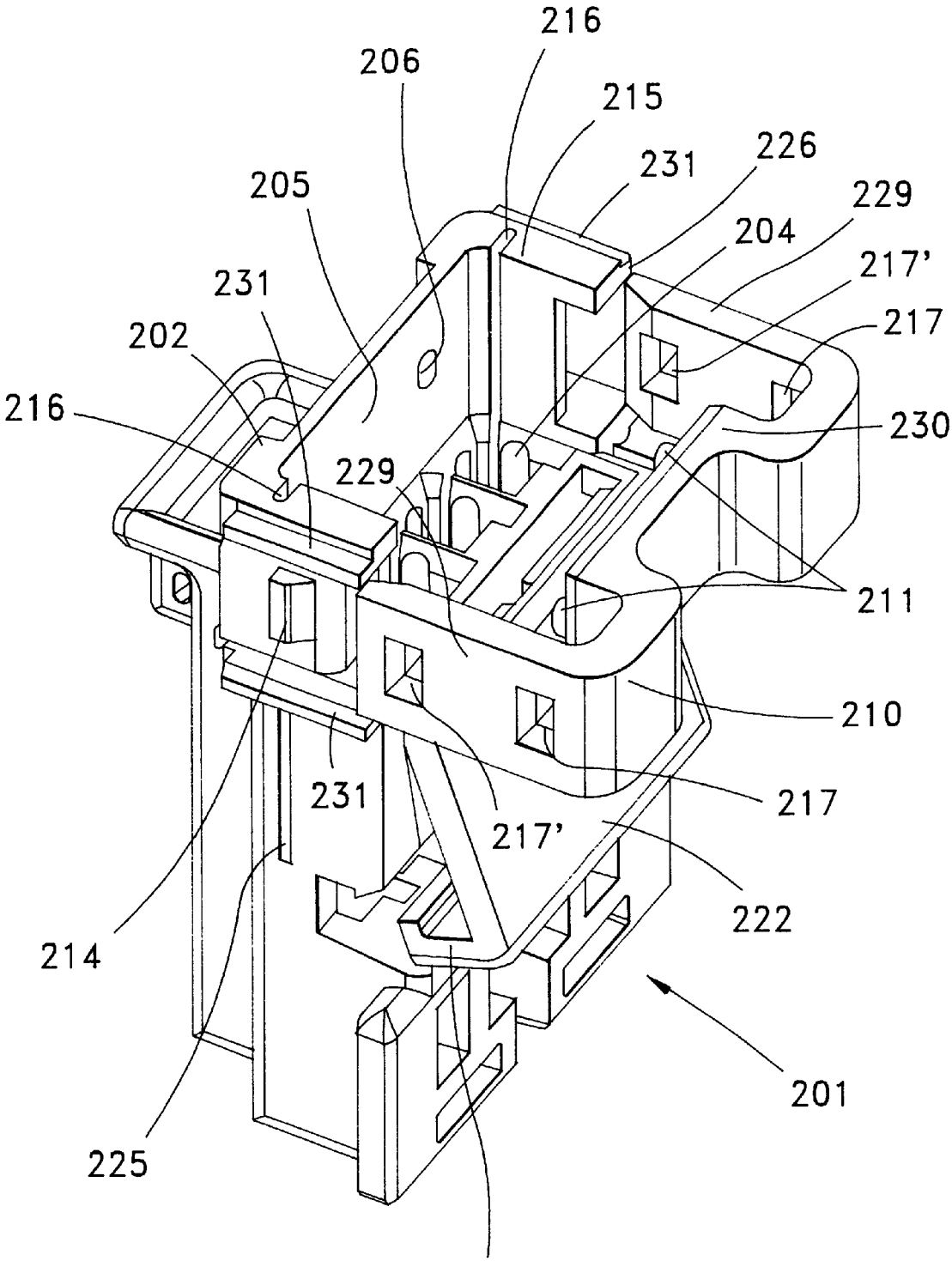
FIG. 5 shows a perspective view of a housing of a third embodiment of a connector according to the invention.

A perspective view of a housing 201 according to the third embodiment of the connector according to the invention is illustrated in FIG. 5. This housing 201 also has four receiving chambers 204 arranged in one plane for receiving electrical contacts which are accordingly connected to flat foil conductors 219. In this case it can be seen that the walls between the receiving chambers 204 are slit at least in part for receiving the flat foil.

A hinged flap 222 for securing the contacts in the receiving chambers 204 is provided. This engages with its free end 223 in the receiving chambers 204 in such a way that their internal width is reduced and a removal of the electrical contacts is no longer possible.

A movable part 210 is provided with pins 211 which engage in corresponding openings 206 of a back wall 205 in the end position of the movable part 210.

FIG. 5 shows the housing 201 as it appears after injection-moulding. The movable part 211 is connected to the side walls 215 by connecting webs 226. Upon a first actuation of the movable parts 210 these connecting webs 226 break off and the part 210 can be moved perpendicularly to the connection direction towards the back wall 205.

The movable part 210 is constructed so as to be substantially U-shaped with two arms 229 and a base 230 which is arranged parallel to the back wall 205. Latching openings 217 and 217' for latching the movable part 210 on the housing 201 in a pre-latching position and an end position are provided in the two arms 229. Accordingly the side walls 215 have latching lugs 214 which engage in these latching openings 217, 217'. Guide rails 231 are provided on the side walls 215 for guiding the movement of the movable part 210 between which the arms 229 of the movable part 210 are movable.

Figure 6:
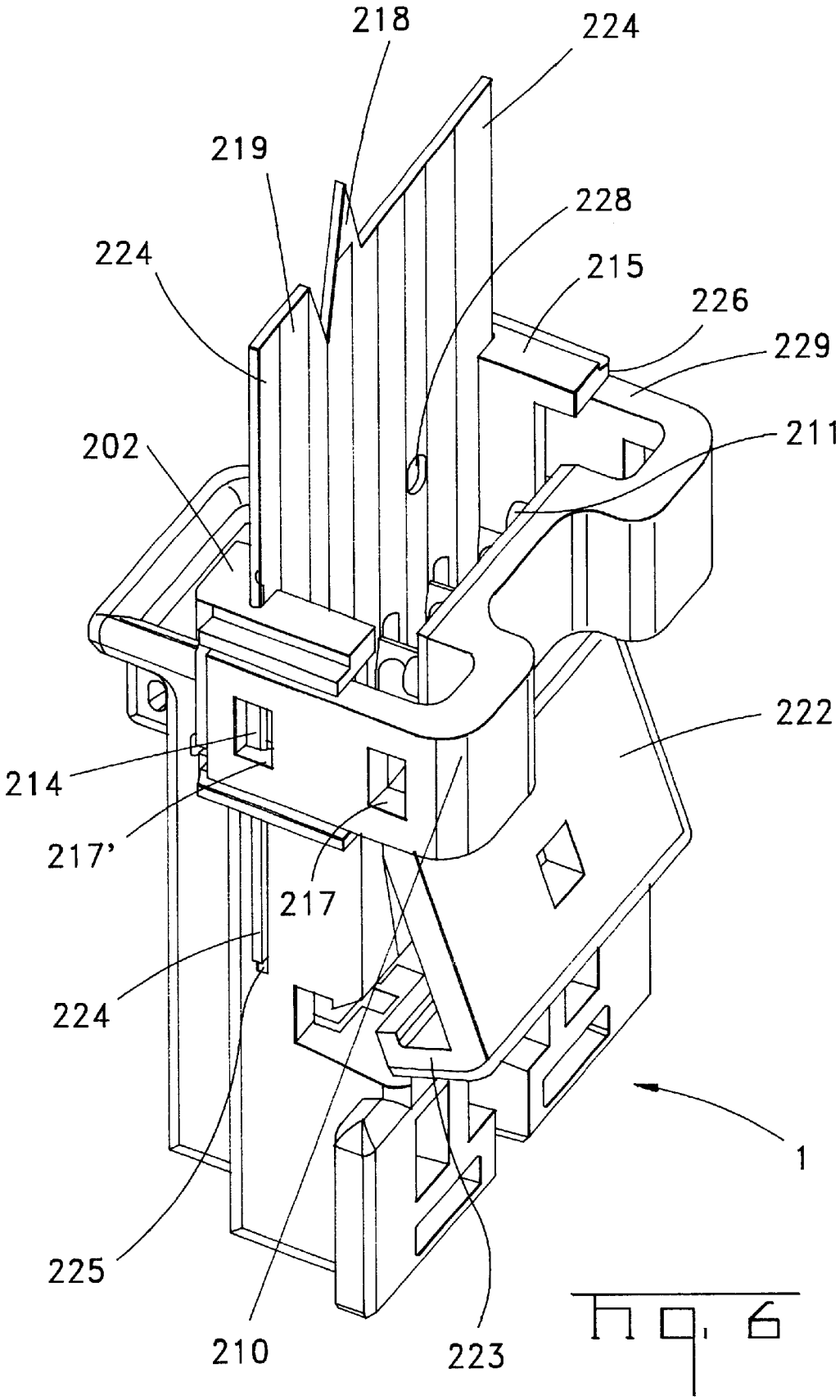
FIG. 6 shows a corresponding perspective view of a connector according to the third embodiment with inserted flat foil and the movable part in pre-latching position.
Figure 7:
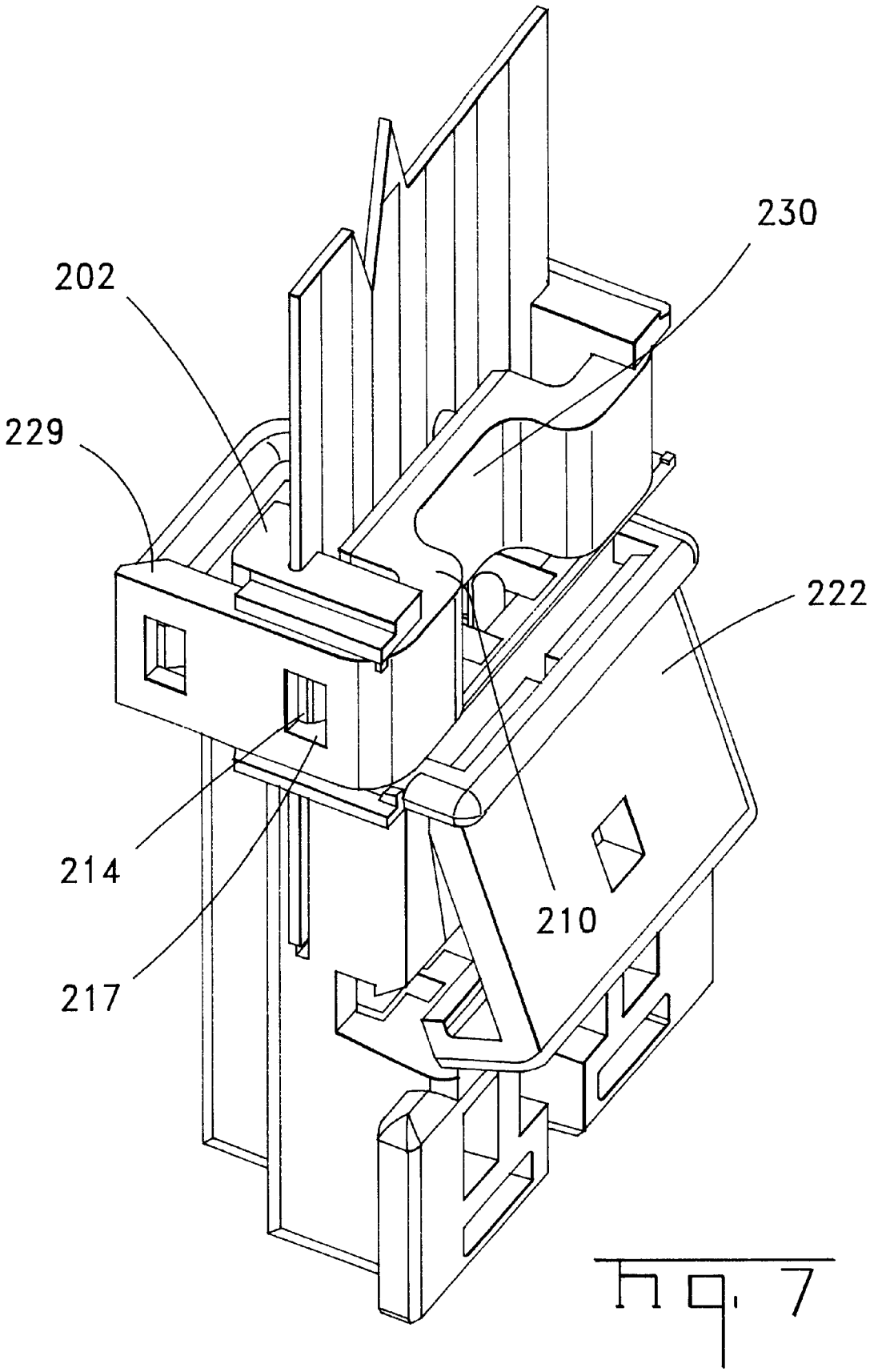
FIG. 7 shows a corresponding perspective view of a connector in accordance with the third embodiment with inserted flat foil in end position.
Figure 8:
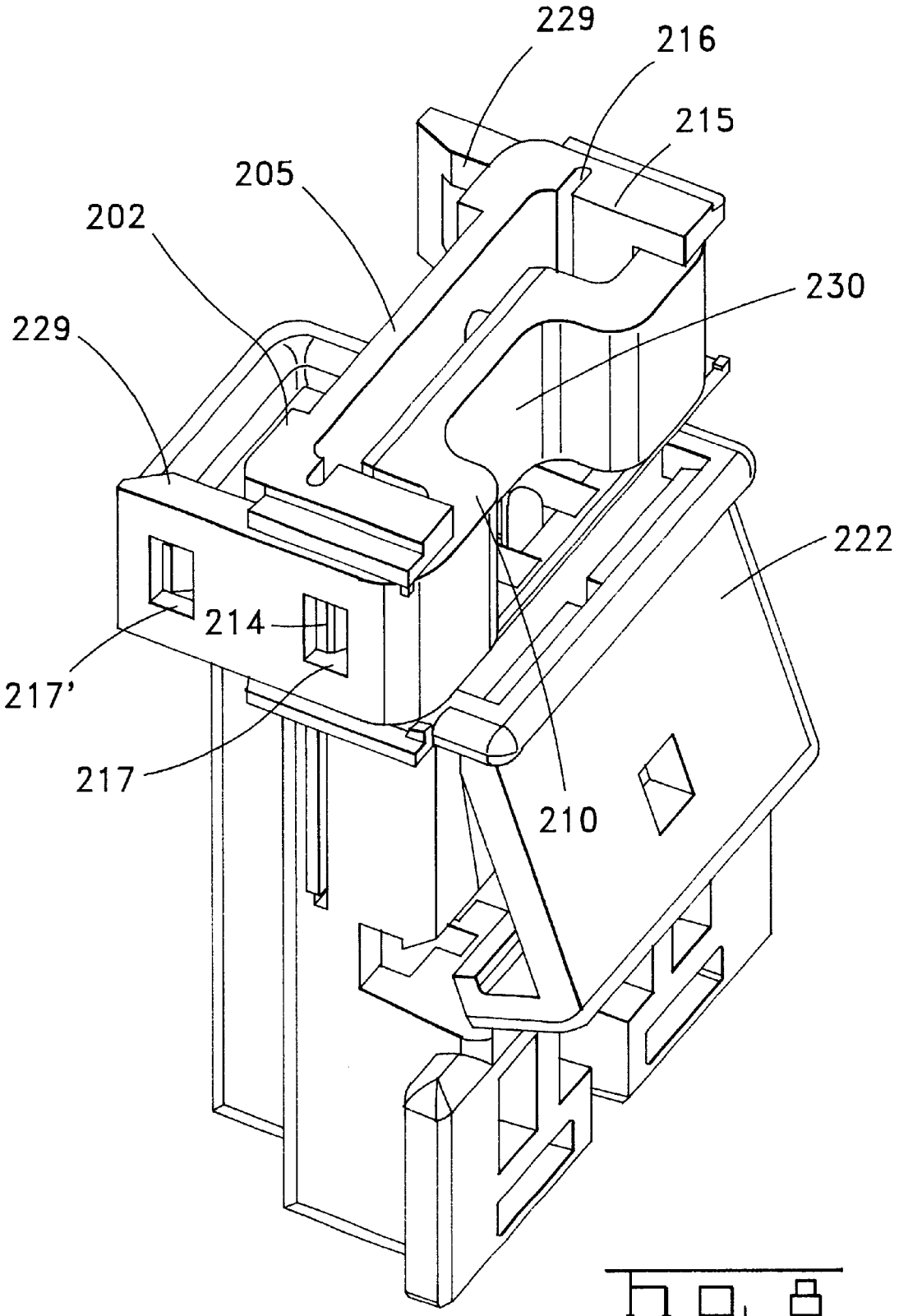
FIG. 8 shows a corresponding connector of the third embodiment in end position but without flat foil.

FIG. 6 shows the movable part 210 in pre-latching position. In this case the latching lugs 214 of the side walls 215 engage in the first latching openings 217' of the arms 229 of the movable part 210. In this position of the movable part 210 the flat foil 218 with the electrical contacts can be inserted into the housing 201. The edges 224 of the flat foil 218 engage thereby in the groove 216 and the slit 225.

In the end position of the contacts, openings 228 are arranged in the flat foil 218 above the openings 206 in the back wall 205. In this position the movable part 210 can now be transferred into the end position. In this case the latching lug 24 latches in the second latching opening 217 of the respective arm 229. The pins 211 engage through the openings 228 in the flat foil 218 in the openings 206 of the back wall 205. A surface pressure of the flat foil 218 between the base 230 of the movable part 210 and the back wall 205 takes place in this end position. This end position is illustrated with foil in FIG. 7 and correspondingly without foil in FIG. 8.

We claim:

1. An electrical connector for terminating at least one flat foil conductor of a flat foil, the connector comprising:

a housing having a cable side end and a front end opposite the cable side end for mating with a mating connector, a top wall extends from the cable side end to the front end, at least one receiving chamber provided in the housing for receiving at least one electrical contact therein;

a hinged flap attached to the top wall extending in a direction toward the front end and movable between a pre-latched position and a latched position, a free end with a lathing portion of the hinged flap is positioned in the at least one receiving chamber when the hinged flap is in the latched position to secure the at least one electrical contact in the at least one receiving chamber;

a movable part attached to the top wall extending in a direction toward the cable side end, the movable part having projections thereon, the movable part is positioned proximate the cable side end and is opposite a back wall of the housing, the movable part is hingeably attached to the top wall of the housing opposite to the hinged flap and is movable between a first position and a second position, the projections of the movable part cooperate with the flat foil to provide strain relief therefore.

2. The electrical connector as recited in claim 1 wherein the movable part is hingeably connected to the housing by a film hinge.

3. The electrical connector as recited in claim 1 wherein the housing has side walls which extend from the back wall, the side walls have latching openings which cooperate with latching lances provided on the movable part to maintain the movable part in the second position.

4. The electrical connector as recited in claim 3 wherein the side walls have grooves which receive edges of the flat foil.

5. The electrical connector as recited in claim 4 wherein slits are provided in the side walls of the housing, the slits extend from the grooves and are provided to receive the flat foil therein.

6. The electrical connector as recited in claim 1 wherein the back wall has projection receiving openings which are configured to receive the projections of the movable part when the movable part is in the second position.

7. The electrical connector as recited in claim 6 wherein to flat foil has corrosponing openings through which the projections extend when the movable part is in the second position, whereby when the flat foil is properly inserted and the movable part is in the second position, the projections cooperate with the projection receiving openings and the corresponding openings, and surfaces of the movable part and the back wall apply pressure to the flat foil, to provide strain relief to the flat foil.

8. An electrical connector for terminating at least one flat foil conductor of a flat foil, the connector comprising:

a housing having a cable side and for receiving the flat foil and a front end opposite the cable side end for mating with a mating connector, a top wall extends from the cable side end to the front end, at least one receiving chamber provided in the housing for receiving at least one electrical contact therein;

a hinged flap attached to the top wall extending in a direction toward the front end and movable between an open position and a closed position, a free end with a latch portion of the hinged flap is positioned in the at least one receiving chamber when the hinged flap is in the closed position to secure the at least one electrical contact in the at least one receiving chamber;

a movable part hingeably attached to the top wall of the housing opposite to the hinged flap extending in a direction toward the cable side end and movable between a pre-latched position and a latched position, the movable part has projections thereon and is positioned proximate the hinged flap, the projections of the movable part cooperate with the flat foil to provide strain relief therefore.

9. The electrical connector as recited in claim 8 wherein the movable part is hingeably connected to the housing by a film hinge.

10. The electrical connector as recited in claim 8 wherein the housing has side walls which extend from a back wall of the housing, the side walls have latching openings which cooperate with latching lances provided on the movable part to maintain the movable part in the latched position.

11. The electrical connector as recited in claim 10 wherein the side walls have grooves which receive edges of the flat foil.

12. The electrical connector as recited in claim 11 wherein slits are provided in the side walls of the housing, the slits extend from the grooves and are provided to receive the flat foil therein.

13. The electrical connector as recited in claim 8 wherein a back wall of the housing has projection receiving openings which are configured to receive the projections of the movable part when the movable part is in the latched position.

14. The electrical connector as recited in claim 13 wherein the flat foil has corresponding openings through which the projections extend when the movable part is in the latched position, whereby when the flat foil is properly inserted and the movable part is in the latched position, the projections cooperate with the projection receiving opens and the corresponding openings, and surfaces of the movable part and the back wall apply pressure to the flat foil, to provide strain relief to the flat foil.

* * * * *